United States Patent [19]

Jacob

[11] 4,074,867

[45] Feb. 21, 1978

[54] METHOD AND APPARATUS FOR COMMINUTING SAND CLODS

[76] Inventor: Hermann Jacob, Fachenfelderweg 115, 2105 Seevetal 3, Germany

[21] Appl. No.: 688,291

[22] Filed: May 20, 1976

[30] Foreign Application Priority Data

May 23, 1975 Germany ..... 2522940

[51] Int. Cl.[2] ..... B02C 19/00

[52] U.S. Cl. ..... 241/30; 241/83; 241/DIG. 10; 209/260; 209/311

[58] Field of Search ..... 241/26, 30, 83, 94, 241/262, 263, 264, 283, DIG. 10; 164/404; 126/155, 158, 162, 167, 169, 176 R, 179, 181; 209/260, 310, 311, 313, 320, 326, 332, 335, 339, 344

[56] References Cited

U.S. PATENT DOCUMENTS

| | | | |
|---|---|---|---|
| 978,589 | 12/1910 | Hutchinson | 126/158 |
| 1,694,211 | 12/1928 | Fernandez | 126/155 |
| 1,931,657 | 10/1933 | Hetzel | 209/326 |
| 2,020,131 | 11/1935 | Behnke | 241/83 |

*Primary Examiner*—Granville Y. Custer, Jr.
*Attorney, Agent, or Firm*—Michael J. Striker

[57] ABSTRACT

A method and apparatus for removing form sand from a casting box and for comminuting and sand clods formed by the sand removed from the box, in which the casting box is placed on a grate having two grate portions, preferably tiltable about spaced tilting axes between a first position, in which the grate portions are located in a common substantially horizontal plane for receiving a filled casting box on its upper surface, and a second position in which the two grate portions extend upwardly inclined from a center line of the grate. The grate portions are vibrated in the first and in the second position by vibrators connected thereto to remove first the form sand from the casting box and to hold, after removing of the casting box and the casting from the grate, any sand clods, which have not been passed through the grate during the first vibration step, between the upwardly inclined grate portions so that the sand clods will rub against each other and the grate portions to be comminuted thereby during the second vibration step.

11 Claims, 9 Drawing Figures

METHOD AND APPARATUS FOR COMMINUTING SAND CLODS

BACKGROUND OF THE INVENTION

The present invention relates to a method and apparatus for removing form sand from a casting box and for comminuting any sand clods formed by the sand removed from the box.

The removal of form sand and the casting from a casting box has up to now been made in such a manner that the filled casting box has been placed with an open end onto a horizontally extending grate, which is vibrated in vertical direction, so that the form sand and the castings molded therein are separated from each other and from the casting box. Some of the sand particles removed from the box stick together, especially if a binder of plastic material is used for the sand particles, to form sand clods of various size. The smaller ones will fall through the grate and have to be subsequently comminuted in a special apparatus, but the larger ones accumulate on the upper grate surface and must be subsequently removed therefrom and be comminuted in corresponding comminuting apparatus.

While principally it is also possible to remove the form sand from a casting box also on a stationary grate, any sand clods which do not fall through the grate must be removed therefrom and subsequently be comminuted.

Even if vibrating grates are used, the large sand clods remaining thereon can be comminuted only with great difficulties, even though they vibrate with the grate, they will spread out on the horizontal upper surface of the grate and thus not rub against each other which would expedite the comminuting thereof. In addition, there is the danger that such sand clods will fall off laterally of the grate. On the other hand, the grates must have a horizontal plane upper surface so that the filled casting box may be properly received thereon.

Various devices are known in the art for comminuting sand clods removed from a casting box. Such devices are especially necessary if the form sand is intermixed with a binder of plastic material. As a rule such apparatus may comprise ball mills, hammer mills or integrators in which the clods are vibrated together with iron parts to comminute or disintegrate the clods. In using such known separate comminuting devices, the sand clods have to be removed from the grate and fed into the additional devices by special transporting arrangements or manually.

The German Pat. No. 532,807 discloses an apparatus for removing form sand from a casting box and for comminuting any sand clods formed by the sand removed from the box, in which the grate comprises two groups of rods extending comb-like with respect to each other and moved by eccentrics with respect to each other. This will cause horizontal movement of the sand clods, which will negatively influence the time the sand clods will remain on the grate.

An additional apparatus for removing form sand from a casting box and for further treatment of the sand is disclosed in the German Gebrausmuster 72 40 595, in which a chamber is mounted on spiral springs and oscillatable by means of an eccentric. The form sand is comminuted and classified through a sieve device having portions of different aperture size. Not sufficiently comminuted sand clods are discharged from the chamber through appropriate chutes to be subsequently further comminuted.

SUMMARY OF THE INVENTION

It is an object of the present invention to provide a method and apparatus for removing form sand from a casting box and for comminuting any sand clods formed by the sand removed from the box.

It is a further object of the present invention to carry out both steps at one and the same place, respectively within one and the same apparatus.

With these and other objects in view, which will become apparent as the description proceeds, the method according to the present invention for removing form sand from a casting box and for comminuting any sand clods formed from the sand removed from the box mainly comprises the steps of placing a casting box, with the sand and the cast products therein, with the open side of the box onto a planar substantially horizontally extending upper grate surface, subjecting the grate to vibration until the sand becomes disconnected from the casting box walls and falls partly through the grate, removing the casting box and the cast produced therein from the grate while leaving any remaining sand clods thereon, and subjecting the grate again to vibrations while changing the planar horizontally extending grate surface to a surface extending upwardly inclined from a center line of the grate.

The apparatus for carrying out the method according to the present invention mainly comprises a grate having at least two grate portions movable between a first position in which the grate portions extend in a common substantially horizontal extending plane and a second position in which the two grate portions extend upwardly inclined from a center line of the grate, and vibrator means connected to the grate portions for vibrating the latter in either of the positions thereof.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
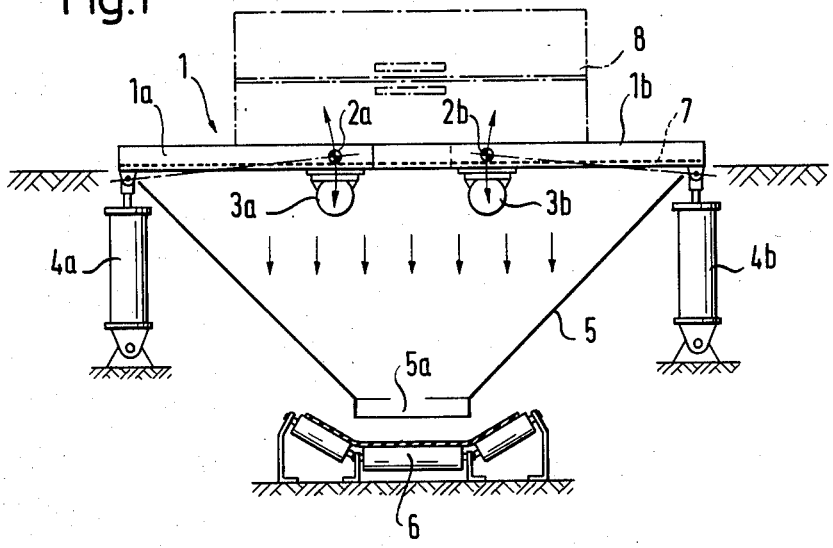
FIG. 1 is a front view of a first embodiment in which the portions of the grate are located in a common horizontally extending plane.
Figure 2:
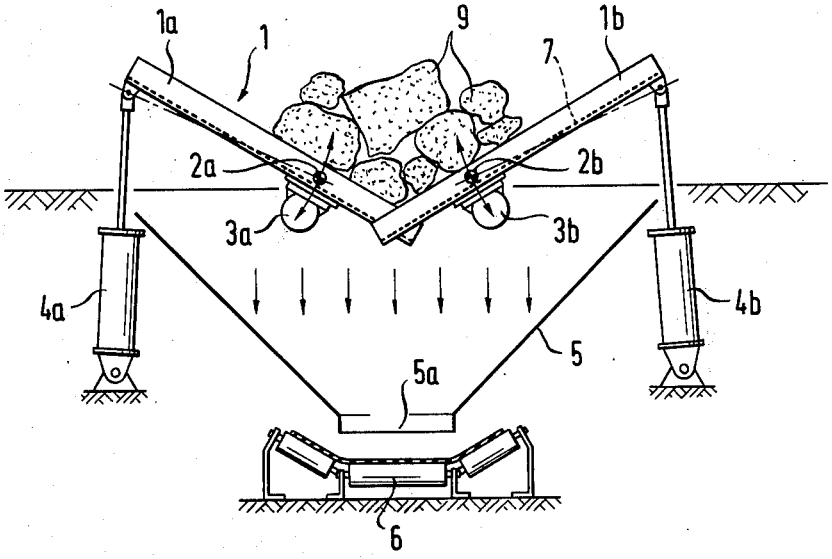
FIG. 2 is a front view of the embodiment shown in FIG. 1 with the grate portions upwardly inclined from a center line of the grate.
Figure 1A:
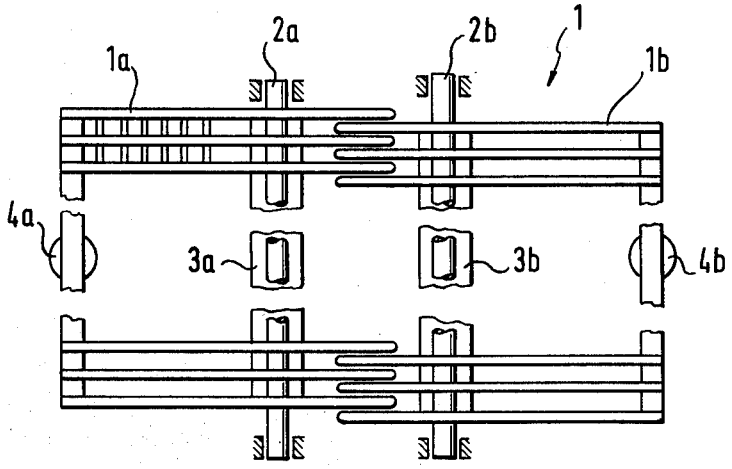
FIG. 1*a* is a top view of the embodiment shown in FIG. 1.

Referring first to the embodiment shown in FIGS. 1 and 2, it will be seen that the apparatus for removing form sand from a casting box and for comminuting any sand clods formed by the sand removed from the box, mainly comprises a grate 1 having two grate portions 1*a* and 1*b* respectively tiltable about fixed horizontally extending axes 2*a* and 2*b*. It is to be understood that each of the grate portions 1*a* and 1*b* comprises a plurality of parallel bars arranged on edge spaced from each other with the inner ends of the bars of the two grate portions overlapping each other. In this embodiment the tilting axes 2*a* and 2*b* are arranged closer to the inner ends of the bars than to the outer ends. Each of the grate portions 1*a* and 1*b* is supported at the outer end thereof by height-adjustable supporting means, here shown as fluid-operated cylinder-and-piston means 4*a* and 4*b* tiltably mounted at their lower ends on a foundation, whereas the piston rods of the cylinder-and-piston means are tiltably connected at their free ends to the outer ends of the grate portions 1*a* and 1*b*. By feeding fluid in a known manner beneath the pistons of the cylinder-and-piston means 4*a* and 4*b*, the grate portions may be moved from the position shown in FIG. 1 to the position as shown in FIG. 2, in which the grate portions 1*a* and 1*b* are tilted in upward direction about their respective tilting axes 2*a* and 2*b*.

Vibrators 3*a* and 3*b*, of known construction, are connected respectively to the grate portions 1*a* and 1*b* substantially beneath the tilting axes 2*a* and 2*b* to vibrate the grate portions upon operation of the vibrators. The vibrators 3*a* and 3*b* can be operated independently from each other, out of phase with each other and, if desired, with a different magnitude of vibration. The cylinder-and-piston means 4*a* and 4*b* are likewise operable independent from each other. A receiving funnel 5, as schematically illustrated in FIGS. 1 and 2, is located beneath the grate, having at its lower end a discharge opening 5*a* arranged above a belt conveyor 6.

Each of the grate portions 1*a* and 1*b* may also have, except at their overlapping ends thereof, grate portions extending normal to the longitudinal bars shown in FIG. 1 and welded thereto or instead thereof, or in addition thereto, be provided with a sieve as indicated by the dotted line 7.

A casting box 8 is placed with the lower open end on the grate 1, when the grate portions 1*a* and 1*b* thereof are in the position shown in FIG. 1, and the vibrators 3*a* and 3*b* are actuated so that the form sand in the casting box will become separated from the inner surface of the latter and from the casting formed. The thus loosened sand will in part fall through the openings in the grate into the discharge funnel 5 onto the band conveyor 6 to be transported thereby to a place of further use. The casting box and the castings are then removed from the grate and any remaining sand clods 9 will remain on the upper grate surface. The grate portions 1*a* and 1*b* are then titlted about their tilting axes by the cylinder-and-piston means 4*a* and 4*b* connected to the outer ends thereof to the position as shown in FIG. 2. In this position the sand clods 9 are moved toward each other so that they will rub against each other during renewed actuation of the vibrators to be thereby comminuted into small portions which can fall through the grate openings into the discharge funnel 5 and from there through the outlet end 5*a* of the latter onto the band conveyor 6.

Figure 5:
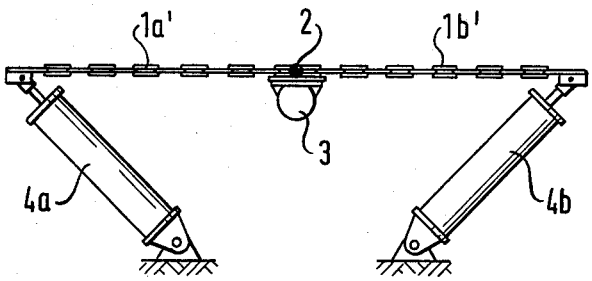
FIG. 5 is a front view of a third embodiment, in which the grate is formed by chain links and showing the portions of the grate located in a common horizontally extending plane.
Figure 6:
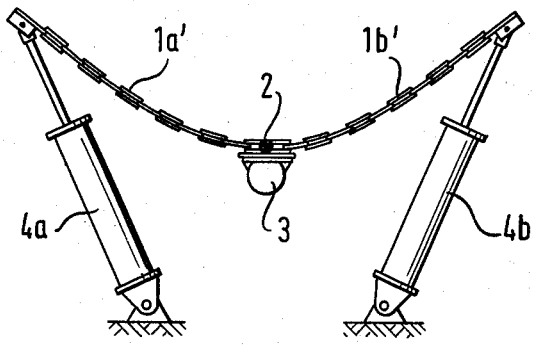
FIG. 6 is a front view of the embodiment shown in FIG. 5 with the grate portions upwardly inclined from a centerline of the grate.
Figure 7:
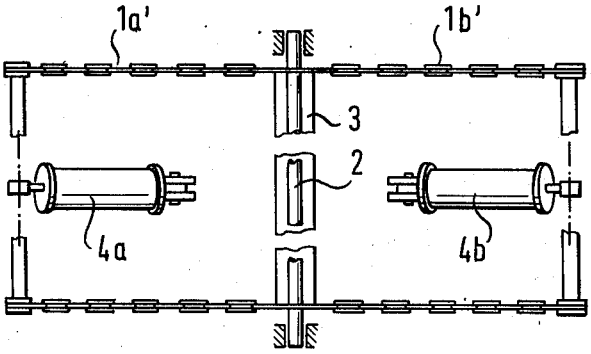
FIG. 7 is a top view of the embodiment shown in FIG. 5.

The apparatus shown in FIGS. 1 and 2 for carrying out the method according to the present invention may be modified in many different ways. Thus, as shown in FIGS. 5–7, the grate may also be formed as a chain-link grate in which the height adjustable supports 4*a* and 4*b* are connected to the outermost links of the grate portions 1*a*′ and 1*b*′, whereas the link between two inner adjacent chain links forms the tilt support 2 of the grate elements. In such a construction the outer supports 4*a* and 4*b* have to be arranged in such a manner so as to engage the outer chain links at the inner periphery thereof and to move the same in such a manner to bring the chain links into a horizontal position as shown in FIG. 1. On the other hand, the outer supports 4*a* and 4*b* are to be arranged also in such a manner that the outer chain links may be raised with respect to the other chain links so that the various chain links will form a parabola with the deepest point of the parabola formed by the chain link between the two adjacent inner links.

Figure 3A:
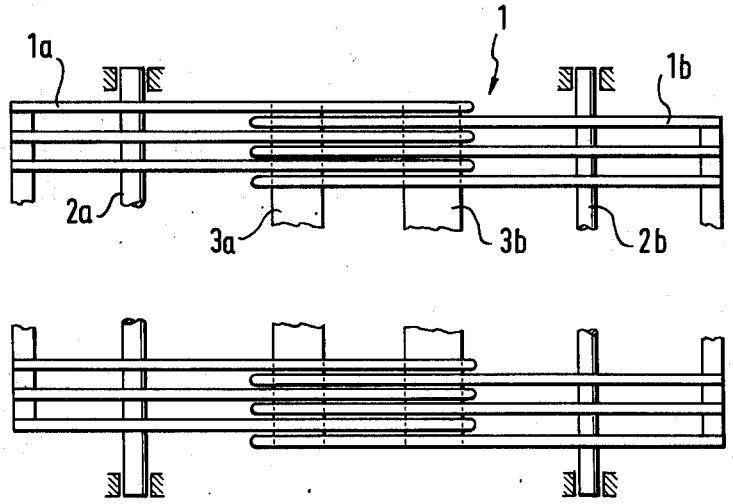
FIG. 3*a* is a top view of the embodiment shown in FIG. 3.
Figure 3:
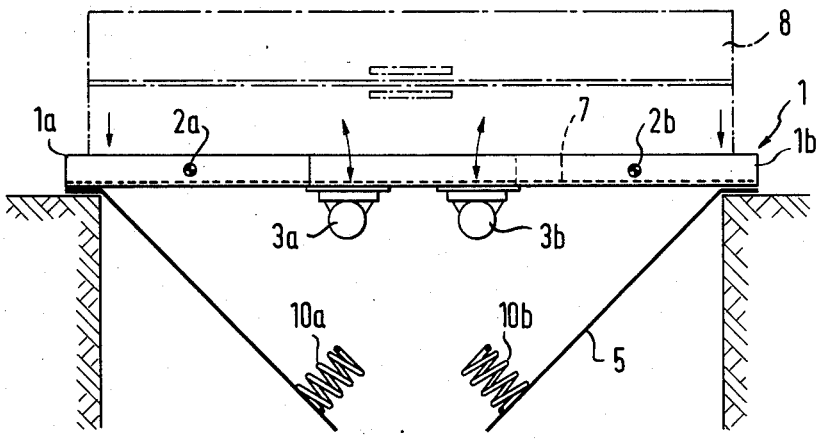
FIG. 3 is a front view of a second embodiment showing the grate portions extending substantially in a common substantially horizontal plane.
Figure 4:
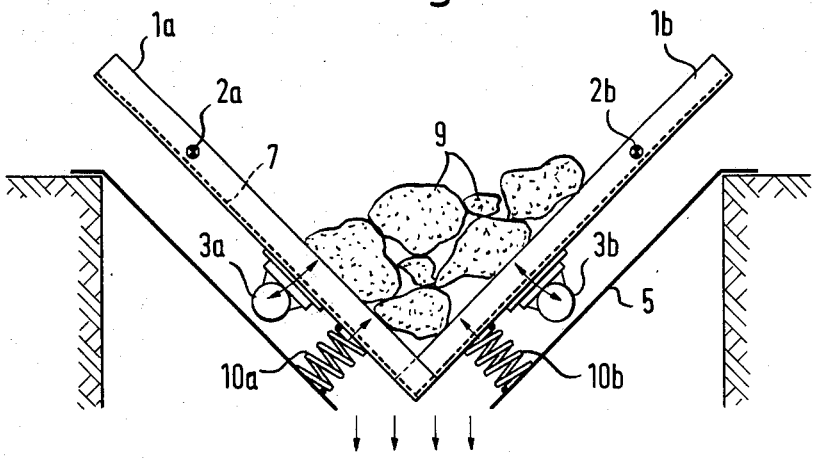
FIG. 4 is a front view of the embodiment shown in FIG. 3 with the grate portions inclined with respect to each other.

FIGS. 3 and 4 illustrate a further embodiment of an apparatus according to the present invention. The apparatus shown in FIGS. 3 and 4 differs from the above-described apparatus illustrated in FIGS. 1 and 2 mainly in that the tilting axes 2*a* and 2*b* of the two grate portions 1*a* and 1*b* are located with respect to the center of gravity of these grate portions in such a manner that the grate portions, even without any sand clods as shown in FIG. 4 resting thereon, will assume the titlted position as shown in FIG. 4. In this tilted position the two grate portions 1*a* and 1*b* are supported in the region of the inner ends by spiral springs 10*a* and 10*b* connected to sidewalls of the discharge funnel.

The grate portions 1*a* and 1*b* of the grate 1 may be brought from the tilted position, as shown in FIG. 4, to the horizontal position, as shown in FIG. 3, by placing an elongated casting box 8 on the grate portions, having a length extending outwardly beyond the tilting axes 2*a* and 2*b*. In the position of the grate portions as shown in FIG. 3 the form sand in the casting box is loosened from the walls of the latter and from the casting formed by actuating the vibrators 3*a* and 3*b* and after removing of the casting box and the castings from the grate, the grate portions will automatically assume the position as shown in FIG. 4 in which the sand clods 9 are concentrated in the region of the center of the grate between the inclined grate portions 1*a* and 1*b*, so that, during renewed actuation of the vibrators, the sand clods will rub against each other to be thereby comminuted.

While the outer ends of the grate portions 1*a* and 1*b* may be supported in the horizontally extending position, as shown in FIG. 3, by foundations or similar stationary supports, as shown in FIG. 3, this is not absolutely necessary since the grate portions 1*a* and 1*b* will assume and be maintained in the horizontal position, as shown in FIG. 3, as long as the elongated casting box is maintained on the grate 1.

In the construction shown in FIGS. 3 and 4 the vibrators 3*a* and 3*b* are connected to the grate portions 1*a* and 1*b* in the region between the tilting axes 2*a* and 2*b*.

It will be understood that each of the elements described above, or two or more together, may also find a useful application in other types of methods and apparatus for removing form sand from a casting box and for comminuting any sand clods formed by the sand removed from the box differing from the types described above.

While the invention has been illustrated and described as embodied in a method and apparatus for removing formed sand from a casting box and for comminuting any sand clods formed by the sand removed from the box, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method for removing form sand from a casting box and for comminuting any sand clods formed by the sand removed from the box, comprising the steps of placing a casting box having an open side with the sand and the cast product therein with the open side of the box on a planar substantially horizontally extending upper surface of a grate; subjecting said grate to vibrations until the sand becomes disconnected from the casting box wall and falls partly through the grate; removing the casting box and the cast product from the grate while leaving any remaining sand clods thereon; and subjecting said grate again to vibrations while changing the planar horizontally extending upper grate surface to a surface extending upwardly inclined from a center line of said grate.

2. A method as defined in claim 1, wherein the step of changing said grate surface comprising the step of tilting portions of said grate about substantially horizontally extending tilting axes.

3. A method as defined in claim 2, wherein said grate portions can be titlted independently from each other.

4. A method as defined in claim 2, wherein said grate portions are vibrated independently from each other.

5. A method as defined in claim 4, wherein said grate portions are vibrated out of phase with each other.

6. Apparatus for removing form sand from a casting box and for comminuting any sand clods formed by the sand removed from the box, comprising a grate having at least two grate portions each having an inner and an outer end and being tiltable about a common longitudinal tilting axis between a first position in which said at least two grate portions extend in a common substantially horizontal plane and a second position in which the outer ends of said grate portions are upwardly displaced out of said plane so that the two grate portions extend upwardly inclined from a center line of the grate; and vibrator means connected to said grate portions for vibrating the latter in either of the positions thereof.

7. Apparatus for removing form sand from a casting box and for comminuting any sand clods formed by the sand removed from the box, comprising a grate having at least two grate portions movable between a first position in which said at least two grate portions extend in a common substantially horizontal plane and a second position in which said at least two grate portions extend upwardly inclined from a center line of said grate, each of said grate portions being tiltable about a fixed axis located between opposite ends of the respective grate portion; means connected to each grate portion spaced from the respective tilting axis for tilting said grate portion about the respective tilting axis between said positions thereof; and vibrator means connected to said grate portions for vibrating the latter in either of the positions thereof.

8. Apparatus for removing form sand from a casting box and for comminuting any sand clods removed from the box, comprising a grate having at least two grate portions movable between a first position in which said at least two grate portions extend in a common substantially horizontal plane and a second position in which said at least two grate portions extend upwardly inclined from a centerline of the grate, each of said grate portions being tiltable about a fixed horizontal tilting axis located between opposite ends of the respective grate portion and said tilting axis of each grate portion being located relative to the center of gravity thereof so that said grate portions normally assume, due to their own weight, said second position; and vibrator means connected to said grate portions for vibrating the latter in either of the positions thereof.

9. Apparatus as defined in claim 8, wherein the length of a casting box from which sand has to be removed is greater than the distance of the tilting axes of the two grate portions from each other so that if a full casting box is placed centrally on said grate portions, the latter are brought from said second to said first position and held by the filled casting box in said first position.

10. Apparatus as defined in claim 8, wherein said grate portions are respectively tiltable about fixed horizontal tilting axes, and including resilient means resiliently supporting said grate portions in said second position intermediate said tilting axes.

11. Apparatus for removing form sand from a casting box and for comminuting any sand clods removed from the box, comprising a grate having at least two grate portions movable between a first position in which said at least two grate portions extend in a common substantially horizontal plane and a second position in which said two grate portions extend upwardly inclined from a center line of said grate, said grate portions being respectively tiltable about fixed horizontal tilting axes; and vibrator means located between said tilting axes and connected to said grate portions for vibrating the latter in either of the positions thereof.

* * * * *